US008157921B2

(12) United States Patent
Kruse

(10) Patent No.: US 8,157,921 B2
(45) Date of Patent: Apr. 17, 2012

(54) APPARATUS FOR CLEANING HEAT EXCHANGING SURFACES, ASSEMBLY HAVING A HEAT INSTALLATION AND AN APPARATUS FOR CLEANING HEAT EXCHANGING SURFACES OF THE HEAT INSTALLATION AND METHOD FOR CARRYING OUT RELATIVE MOVEMENT BETWEEN A SUPPLY LINE AND A HEATING INSTALLATION

(75) Inventor: Volker Kruse, Wesel (DE)

(73) Assignee: Clyde Bergemann GmbH, Wesel (DE)

( * ) Notice: Subject to any disclaimer, the term of this patent is extended or adjusted under 35 U.S.C. 154(b) by 499 days.

(21) Appl. No.: 11/446,933

(22) Filed: Jun. 5, 2006

(65) Prior Publication Data

US 2006/0260652 A1 Nov. 23, 2006

Related U.S. Application Data

(63) Continuation of application No. PCT/EP2004/013755, filed on Dec. 3, 2004.

(30) Foreign Application Priority Data

Dec. 5, 2003 (DE) ..... 103 57 021

(51) Int. Cl.
*B08B 9/02* (2006.01)
*F28G 1/16* (2006.01)

(52) U.S. Cl. ..... 134/22.1; 134/167 R; 134/166 C; 122/379; 138/119; 138/137; 138/DIG. 8; 138/107; 248/74.3

(58) Field of Classification Search ..... 134/167 R, 134/168 R, 172, 166 C, 169 C, 22.1
See application file for complete search history.

(56) References Cited

U.S. PATENT DOCUMENTS 3,216,046 A 11/1965 Chappell
3,284,036 A * 11/1966 Nansel ..... 248/49
5,108,350 A * 4/1992 Szpakowski ..... 474/207
5,341,406 A 8/1994 Jens et al.
5,564,371 A 10/1996 Ashton et al.
(Continued)

FOREIGN PATENT DOCUMENTS

CN 1186548 A 7/1998
(Continued)

OTHER PUBLICATIONS

Chinese Office Action dated Aug. 22, 2008.
(Continued)

*Primary Examiner* — Michael Barr
*Assistant Examiner* — Jason Riggleman
(74) *Attorney, Agent, or Firm* — Laurence A. Greenberg; Werner H. Stemer; Ralph E. Locher

(57) ABSTRACT

An apparatus for cleaning heat exchanging surfaces includes at least one supply line for a cleaning fluid. The supply line has an end and an extent axis. The supply line is bendable in a first direction transverse to the extent axis and resistant to bending in at least one second direction transverse to the extent axis. At least one fluid distribution device is disposed at the end of the supply line. The supply line may be telescopic. An assembly having a heating installation and an apparatus for cleaning heat exchanging surfaces of the heating installation, and a method for carrying out a relative movement between at least one supply line and a heating installation, are also provided.

27 Claims, 5 Drawing Sheets

U.S. PATENT DOCUMENTS

| | | | | |
|---|---|---|---|---|
| 6,050,227 | A * | 4/2000 | LaMotte | 122/379 |
| 6,543,392 | B1 | 4/2003 | Ashton, III et al. | |
| 6,681,839 | B1 * | 1/2004 | Balzer | 165/11.2 |

FOREIGN PATENT DOCUMENTS

| | | | |
|---|---|---|---|
| DE | 2 007 781 | | 10/1970 |
| DE | 692 13 370 | T2 | 9/1996 |
| DE | 195 33 071 | A1 | 3/1997 |
| EP | 0 391 038 | B1 | 12/1992 |
| EP | 0 607 629 | A1 | 7/1994 |
| EP | 0 526 120 | B1 | 9/1996 |
| EP | 1 256 761 | A2 | 11/2002 |
| GB | 2004534 | A | 4/1979 |
| JP | 61016485 | U | 1/1986 |
| JP | 63294497 | * | 12/1986 |
| JP | 07019793 | A | 1/1995 |
| JP | 9505526 | T1 | 6/1997 |
| JP | 2001180093 | A * | 6/2000 |
| JP | 2003156211 | A | 5/2003 |
| SE | 506331 | * | 12/1997 |
| WO | 9816329 | A2 | 4/1998 |
| WO | 01/44704 | A2 | 6/2001 |
| WO | 01/65179 | A1 | 9/2001 |

OTHER PUBLICATIONS

English translation of Japanese Office Action dated Mar. 9, 2010.

* cited by examiner

FIG. 2
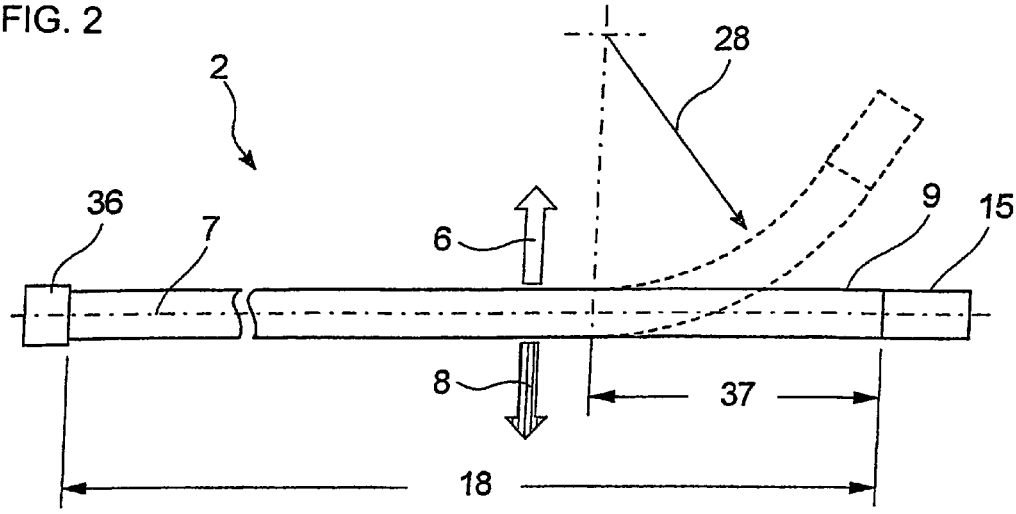
FIG. 3A
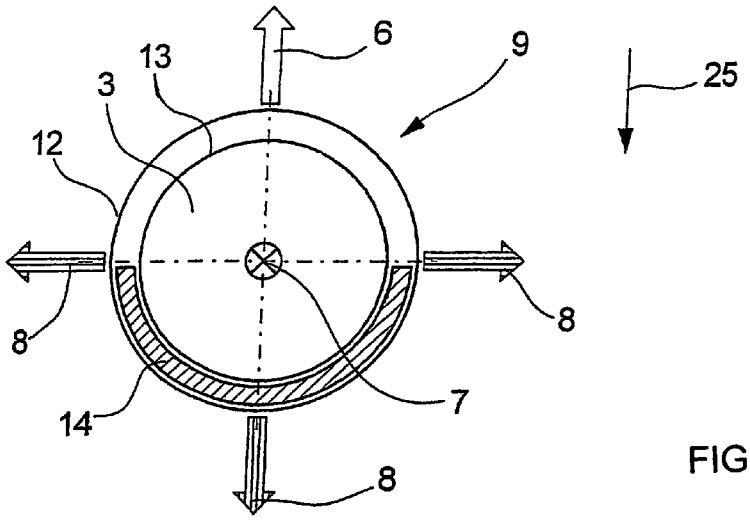
FIG. 1
FIG. 3B
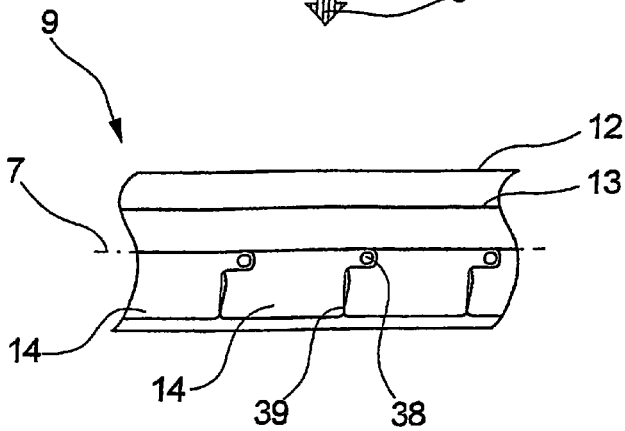

APPARATUS FOR CLEANING HEAT EXCHANGING SURFACES, ASSEMBLY HAVING A HEAT INSTALLATION AND AN APPARATUS FOR CLEANING HEAT EXCHANGING SURFACES OF THE HEAT INSTALLATION AND METHOD FOR CARRYING OUT RELATIVE MOVEMENT BETWEEN A SUPPLY LINE AND A HEATING INSTALLATION

CROSS-REFERENCE TO RELATED APPLICATION

This is a continuation, under 35 U.S.C. §120, of International Application No. PCT/EP2004/013755, filed Dec. 3, 2004, which designated the United States; this application also claims the priority, under 35 U.S.C. §119, of German Patent Application 103 57 021.7, filed Dec. 5, 2003; the prior applications are herewith incorporated by reference in their entirety.

BACKGROUND OF THE INVENTION

Field of the Invention

The invention relates to an apparatus for cleaning heat exchanging surfaces, including at least one supply line for a cleaning fluid and at least one fluid distribution device disposed at one end of the at least one supply line. Such apparatuses are normally used for cleaning boilers or other components of heating installations or combustion installations which are subject to flue gases. The present invention also relates to an assembly having a heating installation and an apparatus for cleaning heat exchanging surfaces of the heating installation and to a method for carrying out a relative movement between the at least one supply line and a heating installation.

The combustion that takes place in heating installations results in the formation of ash, slag or similar contaminants, which in the end are deposited on the walls and heat exchanging surfaces of the combustion chambers, of the heat exchangers, and of the flue outlet, etc. That results, in particular, in the heat exchanging surfaces which are intended for exchanging heat having an increasingly poorer efficiency during operation. It is therefore necessary for those heat exchanging surfaces including, inter alia, boiler walls, pipe runs, heat exchanger surfaces and the like, to have the adhering ash and slag removed from them. Basically, three different concepts are known for cleaning the heat exchanging surfaces of heating installations, steam power plants, refuse incineration installations or similar installations which have combustion chambers.

A first concept for cleaning such heat exchanging surfaces is disclosed, for example, in International Publication No. WO 01/65179, corresponding to U.S. Pat. No. 6,691,646, which describes a so-called water lance blower. Water lance blowers have a water lance which is disposed with its mouth on or in a hatch in the heating installation in such a way that it can be pivoted and can blow a water jet through the heating installation, which is in operation and through which flames and/or flue gases are flowing, onto wall areas which can be reached from the hatch. The water lance blower described therein has at least two drive units for controlling the water lance as well as a holding apparatus for attaching the water lance blower to the heating installation, with parts of the water supply system being integrated in the holding apparatus. That means that the physical size of the water lance blower is limited substantially to the pivoting range of the water lance.

Water lance blowers such as those emit a narrow water jet through the firebox onto the opposite wall. The kinetic water jet energy and the sudden vaporization in the pores of the deposits result in detachment of the contamination that is composed of soot, slag and ash. Due to the fact that considerable distances sometimes have to be covered in that case, water lance blowers such as those have a relatively high pressure applied to them. In order to prevent obstructions, openings or other sensitive zones of the heating installation from coming into contact with such water jet energy, the area which is struck by the water jet that is produced by the water lance blower in general follows a specific predeterminable path on the surface to be cleaned, which is also referred to as the blowing figure. However, as a result of the fact that the mouth of the water lance is fitted in a fixed position in the combustion wall, that is to say it does not move into inner areas of the heating installation, all of the heat exchanging surfaces which can be reached directly are all that can be cleaned. It is not possible to reach heat exchanging surfaces which are disposed behind edges, projections etc., nor, for example, to clean pipe runs over a large portion of the circumference.

Furthermore, an apparatus for on-line boiler cleaning for waste incineration installations is known from European Patent Application EP 1 256 761 A, in which the cleaning agents are supplied through the use of a heat-resistant flexible tube that hangs down vertically from above. That flexible tube is disposed through a supply tube at the upper end of an empty flue and is moved downwards from above in a predetermined manner, with its nozzle at the same time distributing the cleaning agent uniformly over its circumference. An apparatus such as that can be used in particular where it is not possible to access the heating installation or the heat exchanging surfaces to be cleaned, from the side. In the case of a hanging configuration of the flexible tube such as that, the nozzle is preferably constructed in such a way that the emerging forces compensate for one another as the cleaning agent flows out, so that the nozzle head accordingly remains in a stable position.

Finally, so-called soot blowers are also known, for example as disclosed in European Patent EP 0 391 038 B1, corresponding to U.S. Pat. No. 5,040,262. Soot blowers are likewise used for cleaning hot surfaces, for example in boilers and heat exchangers. A pressurized fluid, for example air, water, water vapor or steam, is supplied to the soot blowers and is expanded in the nozzles to the environmental pressure in the heat exchanger. The blast jets which are formed at the outlet from the nozzles are then used, with their high kinetic energy, to remove the undesirable coatings on the heat exchanger surfaces. Those nozzles are disposed on a blast tube, which is moved into the interior of the heating installations in order to carry out the cleaning process. The nozzles, which are disposed at the end and/or distributed on the circumference, thus each clean different areas of the heat exchanging surfaces. In that case, soot blowers are known which additionally carry out their own rotational movement, in addition to a translational movement relative to the heating installation. That results in the water jets which originate from the blast tube progressing in a helical shape through the internal area of the heating installation. Bearing in mind the size of heating installations such as those, it is clear that a blast tube such as that likewise has a considerable length, for example up to 10 meters. Since, however, the blast tube is moved completely out of the internal area of the heating installation after the cleaning process, that means that a considerable amount of space is likewise required in the vicinity of the soot blower outside the heating installation. Due to that large amount of space that is required, soot blowers such as those can be used only to a very restricted extent, despite having a particularly good cleaning effect due to their relative movement with respect to the components in the interior of the heating installation.

SUMMARY OF INVENTION

It is accordingly an object of the invention to provide an apparatus for cleaning heat exchanging surfaces, an assembly having a heating installation and an apparatus for cleaning heat exchanging surfaces of the heating installation and a method for carrying out relative movement between a supply line and a heating installation, which overcome the hereinafore-mentioned disadvantages and solve the technical problems of the heretofore-known devices and methods of this general type.

In particular, one object of the present invention is to propose an apparatus for cleaning heat exchanging surfaces, which on one hand has a particularly good cleaning effect, but at the same time requires only a small amount of space outside a heating installation such as this. Furthermore, the apparatus is intended to be suitable for use in the long term even in the conditions which prevail on or in thermal power stations, in particular having little susceptibility to temperature and contamination. A further aim is to propose a method which on one hand allows effective cleaning of heat exchanging surfaces, but at the same time covers handling of the cleaning apparatus in a manner which allows a space-saving configuration. A further aim is to propose a heating installation having an apparatus for cleaning heat exchanging surfaces, which is distinguished by long operating cycles and a small amount of space being required.

With the foregoing and other objects in view there is provided, in accordance with the invention, an apparatus for cleaning heat exchanging surfaces. The apparatus comprises at least one supply line for a cleaning fluid. The at least one supply line has an end and an extent axis. The at least one supply line is bendable in a first direction transverse to the extent axis and resistant to bending in at least one second direction transverse to the extent axis. At least one fluid distribution device is disposed at the end of the at least one supply line.

For purposes of clarity, it should be noted first of all that the term "heat exchanging surfaces" covers in particular all boundary surfaces of boilers, fireboxes, heat exchangers, pipe runs, etc. In particular, the term therefore means all surfaces which come into contact with the combustion products themselves, or with the exhaust gases, particles, etc. which result from them. Heat exchanging surfaces such as those can also be identified, for example, by soot, slag, ash or similar contamination in the form of combustion products being deposited on those heat exchanging surfaces during operation.

The expression "supply line" preferably means a structure in the form of a tube or flexible tube. The materials of a supply line such as this should be heat-resistant, and preferably also corrosion-resistant. The cross section or the diameter of a supply line such as this should be chosen in particular as a function of the cleaning fluid being used. Gaseous and/or liquid fluids may be used as the "cleaning fluid", for example air, water, water vapor, steam, etc. Fundamentally, it is possible for an apparatus such as this to have a plurality of such supply lines, for example in order to allow cleaning to be carried out at the same time at different points, without having to move the apparatus itself or the supply line. In addition, it is also possible for further supply lines to be provided which, however, are used for other functions rather than for a cleaning fluid.

A fluid distribution device is disposed at the end of the at least one supply line. In this case, the word "end" means that area of the supply line which is disposed in the vicinity or is aligned in the direction of the heat exchanging surfaces. The supply line normally has an opposite, other end, which is connected to a stationary water supply system. However, in some circumstances, it is also possible for the supply line to have a plurality of fluid distribution devices, in which case, however, at least one is fitted at the end. A large number of different distribution devices may be used as the "fluid distribution device", preferably ensuring a uniform distribution of the fluid over the circumference or in an extension to the supply line. Slots, nozzles or the like are provided, for example, in order to achieve a distribution effect such as this, allowing the cleaning fluid to be emitted from the supply line. In this case, these slots, nozzles, etc. may also vary, if required, in their position or location with respect to the end of the supply line.

According to the invention, the at least one supply line is constructed in such a way that it can be bent in a first direction transversely with respect to an extent axis, and is constructed to be resistant to bending in at least one second direction transversely with respect to the extent axis. The expression "extent axis" means, in particular, the center axis of a supply line such as this. In this case, in particular, this means the state of the supply line in which the supply line has a straight profile. If a straight profile of the supply line such as this is now considered, it is thus possible to bend the supply line in at least one direction transversely with respect to the extent axis. It is thus possible to vary the radius of curvature of the supply line, specifically from a straight profile (radius of curvature=infinity) towards smaller radii of curvature. In contrast to a conventional flexible tube, such deformation or bending of the supply line is not, however, possible in all directions. Such deformation is not possible in at least one second direction transversely with respect to the extent axis. In other words, this means that at most a straight profile of the supply line can be achieved in this direction so that, furthermore, bending is not possible, or is possible only subject to damage to or destruction of the supply line at the same time. A configuration of the supply line such as this makes it possible on one hand, for example, to roll up the supply line or to pass it around corners or the like, while at the same time ensuring robustness of the supply line in such a way that the supply line is self-supporting, at least in places. This means, by way of example, that the supply line can be disposed in such a way that no significant deformation takes place just as a result of the force of gravity even in the case of a horizontal configuration or a configuration which is inclined with respect thereto. A supply line such as this can thus project at least with a specific supporting section beyond a guide point or holding point, and can in this case have a substantially straight profile. If the field of use of apparatuses such as these, as described in the introduction, is considered, this therefore means that a supply line such as this can, for example, be inserted horizontally into a heating installation and can have a self-supporting, straight form there, while the supply line can be bent outside the heating installation and, to a certain extent, even close to the heating installation. This allows apparatuses such as these to be disposed in a particularly space-saving manner.

For clarity, it should be noted at this point that wording such as "resistant to bending", "straight profile" and "horizontal" should be understood not only in the absolute sense. It is clear to those skilled in the art that the natural weight of an apparatus such as this (in particular in use), as well as manufacturing and/or installation tolerances, lead to load deformation (which in this case is regarded as being insignificant). This load deformation is, for example, in the region of less than 30% (in particular less than 20% and preferably less than 10%) of the free supporting section of the supply line. In other words, by way of example, this means that it can still be assumed that the supply line is an "embodiment which is resistant to bending" if it has a (vertical) load deformation of about 1 meter over a free (horizontal) supporting section of about 3.50 meters.

In accordance with another feature of the invention, the at least one supply line is in the form of at least one heat-resistant, flexible tube. Although, in principle, combinations of pipe sections and flexible tube parts are possible, a flexible tube is preferably used since this results in further advantages in terms of the particularly flexible nature of the deformation over the entire length of the supply line. Further details relating to this will be explained in the following text. For example, a heat-resistant flexible tube may be formed from metal. In this case, a steel which is resistant to high temperatures and corrosion may be used. The flexibility of the flexible tube is, however, restricted at least to such an extent that it is resistant to bending in at least the second direction transversely with respect to the extent axis. This is preferably a flexible tube in the form of a corrugated hose. The corrugation may also be protected by a protective sleeve, for example a robust mesh, against external contamination and/or damage.

In accordance with a further feature of the invention, devices are provided which restrict the flexibility of the at least one flexible tube in a second direction. These devices may be implemented in various ways. For example, it is possible to position devices such as these externally on the surface of the flexible tube, to provide them on the inside of the flexible tube and/or for the flexible tube itself to provide such devices by a different choice of material or by having a different configuration. These devices are advantageously themselves resistant to high temperatures, are positioned in such a way that they are protected against temperature, and/or are (actively/passively) cooled. By way of example, the cleaning fluid itself can be used as a cooling medium. At least some of the devices for restriction of the flexibility of the flexible tube are then in direct contact with the cleaning fluid in the interior of the at least one flexible tube, advantageously with the cleaning fluid flowing around it. In combination or as an alternative thereto, the devices may at least partially form a thermal bridge, thus ensuring rapid heat dissipation from hot spots (for example also through the use of materials with a high thermal conductivity, etc.). The flexible tube is also fundamentally preferably constructed in such a way that its flexibility is restricted in a plurality of directions. This makes it possible, for example, to also ensure stable lateral guidance of the flexible tube, in addition to a stable lower face. It is particularly preferable to place chain belts in the interior of the flexible tube, which can be pivoted in a restrictive form substantially on only one plane.

In accordance with an added feature of the invention, the devices have at least one of the following components: holding elements which can pivot in one dimension, and curvature limiters. The components mentioned herein are preferably fitted outside the supply line and/or the flexible tube.

In this case, the "holding elements which can pivot in one dimension" can preferably be used as a type of holder for the flexible tube. The holding elements are connected through a joint in such a way that they can pivot with one another, and have stop edges which limit the pivoting. In this case, the pivoting radius is limited in such a manner that the holding elements have a straight profile in a stable position. The holding elements are preferably disposed on one side of the supply line or of the flexible tube and the supply line is disposed in the second direction, starting from the extent axis.

The "curvature limiters" may, for example, be positioned on the surface close to the first direction. By way of example, they may be constructed in such a way that a separate chain is fixed on the surface at two reference points. When the supply line or the flexible tube has a straight profile, the chains are tensioned. Due to the fact that this chain prevents the two reference points from moving further away from one another, they make the flexible tube resistant to bending, at least in one direction. However, since a chain such as this on the other hand does not provide any resistance to the two reference points moving towards one another, such bending or deformation can take place.

In accordance with an additional feature of the invention, the at least one flexible tube has at least two casings, in which case the cleaning fluid can flow in the interior of the second casing, and supporting elements are provided between the first casing and the second casing and make the at least one supply line resistant to bending in at least the second direction. An encapsulated system such as this can preferably be used with respect to the external conditions which occur in thermal power installations. The supporting elements, which in principle may also be in the form of holding elements or curvature limiters that can pivot in one dimension, in this case are protected against external environmental influences by the first casing. In this case, the two casings in principle can also be constructed in such a way that they can be bent or deformed in all directions, however with the provisions of the supporting elements between them restricting the flexibility of the overall flexible tube. The first casing is preferably once again produced from a heat-resistant and corrosion-resistant material, although the second casing may, for example, be produced from plastic or a similar material.

In accordance with yet another feature of the invention, the at least one fluid distribution device is a nozzle head. The expression "nozzle head" covers various embodiments. In particular, a nozzle head relates to a housing with one or more nozzles which are disposed at the front and/or distributed over the circumference. By way of example, slots, holes and/or specific nozzle housings are used as nozzles. In principle, the fluid distribution device should be matched to the desired point of use, in particular being constructed in such a way that, if required, predeterminable surfaces are specifically cleaned. At the same time, in this context, it is also advantageous to also deliberately exclude areas in order to avoid damage to sensitive areas in heating installations to be cleaned as well as to ensure ecologically friendly use of the cleaning fluid. For this purpose, the fluid distribution device is preferably constructed and aligned in such a way that at least one angle range in the circumferential direction or in the longitudinal direction of the at least one flexible tube, that is to say in particular at least one dead angle range, exists.

In accordance with yet a further feature of the invention, the at least one fluid distribution device is advantageously constructed in such a way that it can rotate with respect to the at least one supply line, and/or can distribute cleaning fluid at the same time over the entire circumference. According to the first variant, the fluid distribution device has a drive or is connected to such a drive which allows rotation with respect to the flexible tube. A drive such as this may be driven electrically or else through the cleaning fluid itself. An embodiment such as this is particularly advantageous when only a small number of nozzles are provided and thorough cleaning is intended to be carried out at the same time, or when the nozzles are intended to be deliberately aligned with specific areas of the heat exchanging surfaces. As an alternative to this, or else in combination, the fluid distribution device may also be constructed in such a way that cleaning fluid can be distributed over the entire circumference. In this case, by way of example, it is possible for the fluid distribution device to have a type of baffle plate which forms an annular gap with a housing of the fluid distribution device. The cleaning fluid striking the baffle plate is now deflected and emerges uniformly over the circumference through the annular gap.

In accordance with yet an added feature of the invention, at least one storage apparatus is provided for the at least one supply line in which case this supply line is disposed in or on the at least one storage apparatus in such a way that it is at least partially bent in the first direction. The at least one storage apparatus is preferably an apparatus for rolling up the at least one supply line. The expression "storage apparatus" should be understood as meaning those apparatuses which allow the at least one supply line to be disposed in the non-straight profile. In the simplest case, this may be a type of container into which the at least one supply line is inserted. The at least one supply line is stored in a space-saving manner in the container in accordance with its intrinsic flexibility. Particularly in the situation in which flexibility is provided substantially in only one first direction, a spool or a similar apparatus for rolling up the at least one supply line is proposed as the storage apparatus.

It is also proposed that the storage apparatus have a drive. Such drives as these are, for example, in the form of motors, lifting apparatuses, etc. and preferably assist at least a portion of the movements of the supply line. In the situation where the storage apparatus is a spool, these drives serve the function, for example, of causing the spool to rotate, so that the supply line is wound up. In this case, the supply line is generally wound up in only one layer, that is to say without any further layers of the same supply line alongside one another, and substantially on one plane at right angles to the rotation axis of the spool. Furthermore, it is advantageous for the drive to be constructed with a tensioner. Tensioners such as these have the function, for example, of ensuring that the supply line is wound up with the same prestress on a spool as that which can be achieved, for example, through the use of a sliding clutch.

In accordance with yet an additional feature of the invention, for cleaning heat exchanging surfaces, a device is provided for determination of the length of the at least one supply line with respect to a predeterminable reference point. Devices such as these for determination of the length of the at least one supply line with respect to a predeterminable reference point allow exact monitoring of the cleaning process. In particular, this has the aim of providing information relating to the length of the at least one supply line which has currently already been inserted into the internal areas of a heating installation. In this way, it is also possible to determine the impact point of the cleaning medium. This allows dwell times, insertion and withdrawal rates, and/or other parameters to be matched exactly to the respective areas surrounding the fluid distribution device. By way of example, for safety reasons, at least one limit position detector may alternatively or additionally be provided, to identify when the predeterminable maximum or minimum length is reached.

In accordance with still another feature of the invention, the apparatus has a device for carrying out a relative movement of the at least one fluid distribution device and a reference point of the apparatus. In particular, this relates to drive systems which allow a relative movement, in particular insertion into and withdrawal from a heating installation. In particular, the devices are constructed in such a way that they allow the relative movement to be carried out at a predeterminable speed, with the speed being variable. Devices such as these preferably have at least one drive roller which makes friction contact with the surface of the at least one supply line and is driven by a motor or the like. A configuration in which two roller pairs rest against opposite sections of the supply line, are braced with respect to one another and are driven jointly, is preferred. The rotation of the drive rollers is converted to a translational movement of the flexible tube and of the at least one supply line as a result of the friction contact. This will also be explained in more detail in the following text with reference to the figures.

In accordance with still a further feature of the invention, a device is also advantageously provided for supplying the apparatus with a cleaning fluid, in particular at least one of the following components: a pump, a fluid flow measurement unit, a vaporizer, a valve. The pump is used to feed the cleaning fluid (in particular water) into the apparatus and the at least one supply line. In the situation where cleaning is intended to be carried out, for example, using water vapor or steam, a vaporizer can additionally be integrated, in some circumstances. If it is necessary to switch between cleaning fluids in different phase states (for example liquid and vapor), it is possible, for example, to provide a valve. The mass flow of the cleaning fluid is preferably determined in order to ensure that a uniform cleaning fluid flow always emerges from the fluid distribution device irrespective of the form or the configuration of the at least one supply line. Fluid flow measurement units are used, for example, for this purpose.

With the objects of the invention in view, there is also provided an apparatus for cleaning heat exchanging surfaces. The apparatus comprises at least one telescopic supply line for a cleaning fluid. The at least one telescopic supply line has an end and a water or fluid distribution device is disposed at the end of the at least one telescopic supply line.

The expression "telescopic" means in particular that the supply line is constructed in such a way that its sleeve has areas which can be pushed into one another at least in places. In other words, this means that area elements of the supply line can move towards one another relative to adjacent area elements. Inter alia, this means that the supply line has a maximum length and a minimum length, in which case the supply line can assume any desired length between these two states. In particular, the supply line in this case always has the same alignment and the same extent axis since, however, the area elements are moved only precisely in the direction of this alignment or extent axis. A configuration of the at least one supply line such as this also results on one hand in assurance that one section of the supply line projects well into a heating installation while, on the other hand, only a small amount of space is required outside the heating installation. At this point, it should additionally be noted that a configuration such as this of the at least one supply line with devices and/or configurations, such as those which have been described in conjunction with the at least partially bendable supply line, can be combined. This relates in particular to the embodiments of the fluid distribution device, to the device for determination of the length, to the device for carrying out a relative movement and to the device for supplying the apparatus with a cleaning fluid. Furthermore, one or more apparatuses such as these can be operated separately or together with a heating installation.

With the objects of the invention in view, there is also provided an assembly of a heating installation and a cleaning apparatus for the heating installation. The assembly comprises a heating installation having heat exchanging surfaces, and an apparatus for cleaning the heat exchanging surfaces. The apparatus has at least one supply line for a cleaning fluid. The at least one supply line is to be inserted into the heating installation transversely to the direction of the force of gravity, and the at least one supply line has a variable shape and an end. At least one fluid distribution device is disposed at the end of the at least one supply line.

This relates in particular to a combination of a heating installation with an apparatus as described in the introduction for the cleaning of heat exchanging surfaces and having an at least partially flexible supply line. The supply line is now disposed in such a way that the resistance to bending is provided precisely in that direction in which bending would otherwise take place as a result of the force of gravity. This ensures that, for example in the case of a horizontal configuration of the at least one supply line, the supply line cannot crimp or bend downwards. The supply line can thus also be inserted horizontally into internal areas of the heating installation over at least a certain supporting section, without having to be supported there. At the same time, however, the partial flexibility of the at least one supply line also allows it to be disposed in a space-saving manner after emerging from the heating installation.

As an alternative to this, it is, for example, also possible to use the telescopic configuration of the apparatus to clean heat exchanging surfaces. Due to its flexibility in all directions, for example, it can easily be inserted into the heating installation transversely with respect to the direction of the force of gravity. Its shape then changes as a result of the subsections of the supply line being pushed one inside the other. This also results on one hand in an automatically self-supporting construction for the internal area of the heating installation, while at the same time ensuring a space-saving configuration of the supply line outside the heating installation when the supply line no longer extends into the interior of the heating installation.

In accordance with another feature of the invention, the at least one supply line is constructed in such a way that it can be bent in a first direction transversely with respect to an extent axis, and in such a way that it is resistant to bending in an at least one second direction transversely with respect to the extent axis. The apparatus is disposed in such a way that the second direction corresponds substantially to the direction of the force of gravity. This represents a preferred refinement of the apparatus for the cleaning of heat exchanging surfaces since there is no need for relatively complicated seals between the area elements of the telescopic supply line which can move with respect to one another.

In accordance with a further feature of the invention, the at least one supply line can be passed from the outside into the inner areas of the heating installation through an appropriate supply opening. A device is provided for producing a bend in the at least one supply line outside the heating installation. At this point, it should be noted that the combination of a "bendable soot blower" with a heating installation will now be described as the primary item. However, in principle, a large number of the features described herein can also be used in combination with the "telescopic soot blower". This relates in particular to all of those features which do not relate to the bending process itself, such as the provision of supply openings in general and their sealing or cooling.

An appropriate supply opening is preferably provided at every point at which a supply line is intended to be passed through the heating installation. In this case, a separate supply opening may be provided for each supply line, although it is also possible to move one supply line towards a plurality of supply openings and thus to clean different supply openings successively. The supply openings can preferably be closed again. This ensures that gases or contamination can emerge from the interior of the heating installation in the time period in which the supply line does not extend through the supply opening. The device for producing bending of the at least one supply line is preferably provided in the immediate vicinity of the supply opening. This makes it possible to ensure that the supply line is bent continuously immediately after it emerges from the supply opening and can thus be guided along the heating installation, and in the end can be stored, in a space-saving manner. By way of example, drive units, guides or similar components may be used as the device for producing bending.

In accordance with an added feature of the invention, the at least one supply line extends substantially in the direction of the force of gravity, or is disposed in or on at least one storage apparatus, outside the heating installation. This variant relates in particular to the situation in which the supply line can be bent substantially in only a first direction, which is substantially in the opposite direction to the force of gravity. For this situation, it is advantageous for the at least one supply line to be bent continuously upwards directly after emerging from the heating installation and, for example, to be stored through the use of the storage apparatus on the heating installation or on the wall of the heating installation. Once again, a spool which is preferably suitable for this purpose is mounted on or attached to the heating installation.

In accordance with an additional feature of the invention, the at least one supply line has a substantially straight profile within the heating installation. This is preferably in a substantially horizontal position. In a corresponding refinement of the supply opening, this straight profile can be pivoted. It is thus possible not only to provide a 90° angle between the direction of the force of gravity and the extent axis of the supply line, but preferably also an angle range of from 135° to 45°.

In accordance with again another feature of the invention, a device is provided for sealing the at least one supply opening and/or for cooling the at least one supply line. Due to the fact that the supply opening represents an open connection between the surrounding area and the interior of the heating installation at least for the time period in which the at least one supply line extends through the supply opening, a sealing device is provided in order to prevent the emergence of substances, in particular hazardous substances.

These devices may be in the form of a separate component, or else, for example, in the form of an air flow, etc. The sealing devices are preferably fitted to the heating installation, although they may additionally also be provided on the apparatus for cleaning. It is particularly advantageous to provide a device for cooling the at least one supply line at the same time. This means that, for example, it is possible to provide the at least one supply line with a type of surrounding air jet, which on one hand prevents gases and contamination from reaching the exterior through the supply opening, but is at the same time closely adjacent the one supply line and ensures that the supply line is cooled well into the internal areas of the heating installation. It is also possible to provide a cooling flow such as this in the interior of the supply line itself.

In accordance with again a further feature of the invention, there is provided a device for automatic control of the apparatus. The control device is preferably suitable for initiation, for monitoring and/or for inducing the drive to carry out a relative movement of the supply with respect to a reference point of the apparatus, the initiation and stopping of the cleaning fluid supply, the drive of the supply line to the supply opening, etc. This preferably relates not only to semi-automatic control of the apparatus but also to fully-automatic control. The controller may be either part of the cleaning apparatus or of the heating installation.

With the objects of the invention in view, there is also provided a method for carrying out a relative movement between at least one supply line and a heating installation. The method comprises identifying an initiation parameter, inserting the at least one supply line through an appropriate supply opening into the heating installation, activating a cleaning fluid flow through the at least one supply line in direction of the heating installation, identifying a final parameter, and withdrawing the at least one supply line out of the heating installation through the supply opening. The at least one supply line is at least partially repeatedly deformed, at least in places, during the inserting and withdrawing steps.

This method is carried out in particular with one of the apparatuses as described above for cleaning of heat exchanging surfaces and of a corresponding heating installation. In this case, in particular, the method is primarily carried out semi-automatically or fully-automatically, even during operation of the heating installation.

It is therefore first of all proposed that an initiation parameter be identified. This "initiation parameter" may, for example, be permanently monitored by a controller, although it is also possible for the initiation parameter to be fed into the controller by an operator action. If an initiation parameter such as this is identified, a cleaning process preferably starts to be carried out automatically.

Accordingly, following this, the at least one supply line is inserted into the heating installation through the appropriate supply opening. It may be necessary for this purpose to provide an appropriate drive for carrying out a relative movement between the supply line and the heating installation, to actuate this drive and to monitor such a relative movement through the use of position regiment systems or similar apparatuses.

A cleaning fluid flow is activated even during the insertion process or else only after the desired position has been reached, propagates in the direction of the heating installation through the at least one supply line, and in the end emerges from the fluid distribution device. The cleaning fluid flow may be activated, for example, through the use of valves and/or pumps, in which case a continuous or else stepped increase in the cleaning fluid flow can be provided.

Once the desired cleaning effect has been achieved, which can be described by a suitable final parameter, this final parameter is identified by the system and accordingly initiates the withdrawal of the at least one supply line. In this case as well, the fluid flow may still continue, although this is not necessarily so. However, in the end, the cleaning fluid flow is deactivated at the latest when the supply line has completely emerged from the heating installation. The withdrawal (in the same way as the insertion) of the at least one supply line can be carried out at a constant speed or else at a varying speed or with holding stops.

One important aspect in this case is, however, that the at least one supply line is at least partially repeatedly deformed during insertion and withdrawal. This deformation process in this case includes, for example, the bending of the supply line or else the supply line also being telescopically pushed together. The important factor is that this deformation is repeatable. In other words, this means that this is not a deformation which damages or destroys the at least one supply line, but a deformation which ensures that the at least one supply line is repeatedly returned to an extended, straight profile. In addition, with regard to the bendable configuration of the supply line, it should be noted in this context that the supply line is preferably passed through a bending apparatus, that is to say a part of the supply line is bent, while a directly adjacent part extends in a straight line, in particular horizontally. This curved area element of the supply line in this case moves continuously over the length of the supply line when it is being pushed through this bending apparatus or the drive.

The repeatable deformation of the at least one supply line makes it possible to deflect, to bend or the like the at least one supply line immediately after withdrawal, and thus to fit it to the heating installation in a space-saving manner. At the same time, it is possible for the supply line to project well into internal areas of the heating installation.

In accordance with another mode of the invention, the length and/or the radius of curvature of the at least one supply line is varied during insertion and withdrawal. The length of the supply line is changed in particular in the case of the "telescopic soot blower". The radius of curvature, in contrast, is changed in particular in the "bendable soot blower".

In accordance with a further mode of the invention, the at least one supply line is inserted and withdrawn during operation of the heating installation. This has the advantage of permitting the heating installation to be operated without any shutdown times for cleaning. This lengthens the operating cycles and at the same time improves the effectiveness of the heating installation.

In accordance with a concomitant mode of the invention, the initiation parameter and/or the final parameter is at least one of the following parameters: time, temperature, heat flow, amount of slag. When time is used as the parameter, it is proposed that the cleaning cycle and the method for carrying out a relative movement between the at least one supply line and the heating installation be carried out at time intervals (initiation parameter), with the length of these time intervals being substantially dependent on the operating state and the utilization level of the heating installation. The cleaning duration and the start of withdrawal of the at least one supply line likewise occur after a predeterminable time interval, which can be chosen as a function of the operating state of the heating installation. The cleaning process normally lasts for between 3 and 10 minutes, so that the withdrawal process should be started after a time interval (final parameter) such as this. The temperature can likewise be used as an indication of when a cleaning cycle should be carried out. Specific limit values can be used for this purpose, relating to the exhaust gas temperature, the temperature of the heat exchanging media (cooling liquids, etc.), the temperatures in the walls of the heating installations, etc. It is also possible to determine the heat flow through the heat exchanging surfaces themselves, and to activate the cleaning cycle on this basis. Furthermore, methods are also possible which start a cleaning process as a function of the amount of slag, which can be detected visually or by measurement. Fundamentally, it should also be noted that any desired combination of different parameters may be used as an initiation parameter or final parameter.

Other features which are considered as characteristic for the invention are set forth in the appended claims, noting that the features disclosed in the patent claims can be combined with one another in any desired technically worthwhile manner.

Although the invention is illustrated and described herein as embodied in an apparatus for cleaning heat exchanging surfaces, an assembly having a heating installation and an apparatus for cleaning heat exchanging surfaces of the heating installation and a method for carrying out relative movement between a supply line and a heating installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a side-elevational view of a bendable embodiment of a supply line;

FIGS. 3A and 3B are respective enlarged, cross-sectional and fragmentary, side-elevational views of a further embodiment of a bendable supply line;

DESCRIPTION OF THE PREFERRED EMBODIMENTS

Figure 1:
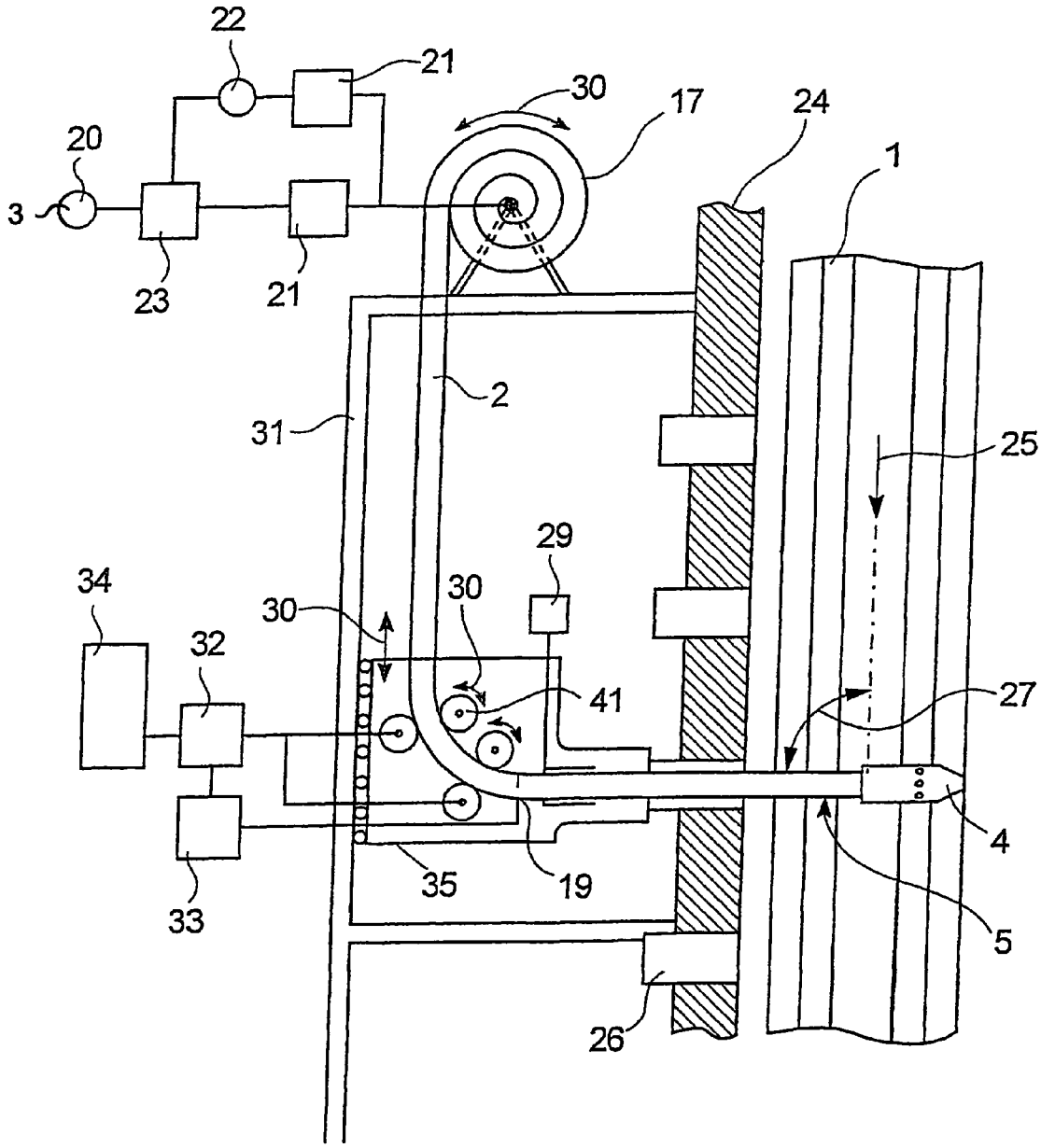
FIG. 1 is a fragmentary, diagrammatic, partially cross-sectional and partially schematic view of a heating installation with one embodiment of an apparatus according to the invention for the cleaning of heat exchanging surfaces.

Referring now in detail to the figures of the drawings, which show particularly preferred embodiments, although the invention is not restricted thereto, and first, particularly, to FIG. 1 thereof, there is seen a fragmenatary, diagrammatic, partially cross-sectional and partially schematic view of a heating installation 24 with an apparatus for cleaning heat exchanging surfaces 1. The illustrated apparatus has a supply line 2 for a cleaning fluid 3, and a fluid distribution device 4 which is disposed at one end 5 of the supply line 2. The heating installation 24, which is illustrated in sectional form in this case, has a plurality of supply openings 26 disposed one above the other. The supply line 2 together with the fluid distribution device 4 is passed through these supply openings 26 into internal areas of the heating installation 24. There, the supply line 2 extends in a self-supporting manner at an angle 27 to the direction 25 of the force of gravity, that is to say without any additional guidance. The angle 27 is preferably in the region of 90° (±10%), although in some circumstances the supply opening 26 is formed in such a way that the supply line 2 can be pivoted with its straight profile close to the end 5, so that the angle 27 can be varied within a range of, for example, 45° to 135°. In this case, the pivoting process is preferably carried out in only one plane, which is defined by the direction of the force of gravity 25 and the position of the corresponding supply opening 26.

A storage apparatus 17 for the supply line 2 is fitted to a frame 31 which is provided outside the heating installation 24. In this case, the storage apparatus 17 is in the form of a spool, onto which the supply line 2 is wound up. For this purpose, the spool or storage apparatus 17 is constructed in such a way that it can rotate in a movement direction 30, with the winding-up process preferably being assisted or ensured through the use of a spring mechanism. This storage apparatus 17, and another or second end of the supply line 2 located there, are connected to an apparatus for provision of the cleaning fluid. This apparatus includes various measures for supplying the apparatus, with a pump 20 first of all being provided and, depending on the requirement, the pumped cleaning fluid 3 being passed through a valve 23, through a vaporizer 22 or directly to the storage apparatus 17. A fluid flow measurement unit 21 is also provided in each path, so that the fluid flow that is produced can be determined. The valve 23 can also be used to start the cleaning process. A pressure measurement and/or adjustment device for determination of the pressure of the cleaning fluid is preferably also provided in the at least one flexible tube 2. By way of example, this device is disposed close to the transition from the at least one flexible tube 2 to a fixed installed (pipe) line system. This device monitors and/or controls the pressure and the amount of cleaning fluid flowing through the flexible tube, in order to ensure a desired (in particular constant) pressure in each case at the fluid distribution device 4. Furthermore, this allows disturbances, wear, contamination, etc. of the fluid distribution device 4 to be identified, so that any required repair work can be initiated.

Additionally, a housing 35 is disposed on the frame 31 and is attached to the frame 31 in such a way that it can move. This ensures, in particular, a translational movement with respect to the frame 31 (as is indicated by a movement direction 30). This makes it possible to insert the supply line 2 into different supply openings 26. In the illustrated embodiment, the housing 35 can be moved only downwards from above or upwards from below, although in principle it is also possible to provide horizontal movements of the housing 35 along the frame 31. The storage apparatus 17 is preferably moved at the same time in this case, so that the supply line 2 is preferably disposed substantially parallel to the direction of the force of gravity 25 between the storage apparatus 17 and the housing 35.

At this point, it should be noted that widely differing refinements of a storage apparatus 17 may be used. In this case, the storage apparatus may be provided in a very simple form by using lifting techniques or storage techniques with free/linked rollers instead of unwinding the supply line. One major function of a storage apparatus such as this is to place the supply line, which is located between a fixed-position and its (cleaning fluid) connection and the fluid distribution device, in a space which is not required for operation of the heating installation.

A device for carrying out a relative movement of the at least one fluid distribution device 4 from a predeterminable reference point 19 of the apparatus is provided in the interior of the housing 35. In the illustrated embodiment, this device includes a plurality of roller pairs 41, which make a friction contact with the supply line 2. These roller pairs 41 are driven through the use of a drive 32, so that the individual rollers rotate. The friction contact with the supply line 2 results in the supply line 2 being pushed through between the roller pairs 41. The fluid distribution device 4 is moved to the right or to the left in the illustrated embodiment, depending on the rotation direction of the rollers in the roller pairs 41. In this case, the roller pairs 41 are constructed in such a way that they result directly in bending or deformation of the supply line 2.

Furthermore, a length measurement device 33 is provided close to the reference point 19 and can be used to determine the extent to which the fluid distribution device 4 has already penetrated into the internal areas of the heating installation 24.

Additionally, a cooling/barrier air supply 29 is provided in the housing 35 and preferably provides a type of surrounding jet around the supply line 2 to the supply opening 26. This prevents contamination or flue gases from emerging to the exterior from the internal areas of the heating installation 24. The device for provision of the cleaning fluid 3, the length measurement device 33, the drive 32 and/or the cooling/barrier air supply 29 are preferably connected to a controller 34, which ensures semi-automatic or completely-automatic insertion and withdrawal of the fluid distribution device 4 into and from the heating installation 24.

FIG. 2 diagrammatically illustrates a first embodiment of a "bendable soot blower", and its supply line 2. The supply line 2, which in this case is in the form of a flexible tube 9, has a connection 36 that is used for connection of the flexible tube 9 to a stationary water supply system. The flexible tube 9 has an end 5 opposite to the connection 36, to which a nozzle head 15 is fitted. When the flexible tube 9 has a straight profile or is disposed in a straight line, it has a straight extent axis 7 which corresponds substantially to a center axis of a round or cylindrical supply line 2. In the illustrated embodiment, the supply line 2 can bend in a first direction 6 transversely with respect to the extent axis 7, and is resistant to bending in at least one second direction 8 transversely with respect to the extent axis 7. This means that the flexible tube cannot bend downwards, as is illustrated by dashed lines at the top. The flexible tube can be bent upwards as far as a predeterminable radius of curvature 28 (for example as far as 400 mm or 500 mm).

As has already been explained with reference to FIG. 1, a flexible tube 9 such as this preferably hangs vertically downwards close to the heating installation 24 and is then bent to a horizontal position. A part of a length 18 of the flexible tube 9, as determined by the device 33, is then pushed into internal areas of the heating installation 24.

In this case, the flexible tube 9 or the supply line 2 is constructed to be self-supporting at least over a predeterminable supporting section 37, that is to say no guidance measures for fixing the horizontal position are required over this supporting section 37. This supporting section 37 preferably extends for at least 1.5 m, and preferably for 2 m, and for particular applications even for more than 3 m. If insertion of the flexible tube 9 with a length 18 of more than about 2 m is intended (for example 8 m or even 12 m), the use of guidance measures is recommended which, for example, support the flexible tube 9 at predeterminable intervals (preferably of about 2 m).

FIGS. 3A and 3B show a further embodiment of a bendable supply line 2, which is once again in the form of a flexible tube 9. This flexible tube 9 has first and second casings 12, 13. In this case, the cleaning fluid 3 can flow in the interior of the second casing 13, and supporting elements 14 are provided between the first casing 12 and the second casing 13 to make the supply line 2 resistant to bending in at least the second direction 8. The sectional view of FIG. 3A shows that the second casing 13 once again has the extent axis 7 located centrally therein. In the embodiment illustrated in this case, the supporting elements 14 are substantially in the form of shells, thus ensuring bending stiffness not only in a second direction 8 parallel to the direction of the force of gravity 25 but likewise bending stiffness in all directions at right angles thereto. The flexible tube 9 can bend only in a first direction 6, which is substantially parallel to and in the opposite direction to the force of gravity 25. In the side view illustrated in FIG. 3B, it can be seen that the supporting elements 14 are connected to one another through joints 38, with a stop 39 being provided in each case at a pivoting angle. In the embodiment illustrated in this case, this means that the supporting elements 14 can admittedly be at a distance from one another close to the stop 39, but bending downwards beyond the straight configuration is not possible because of the stop 39.

Figure 4:
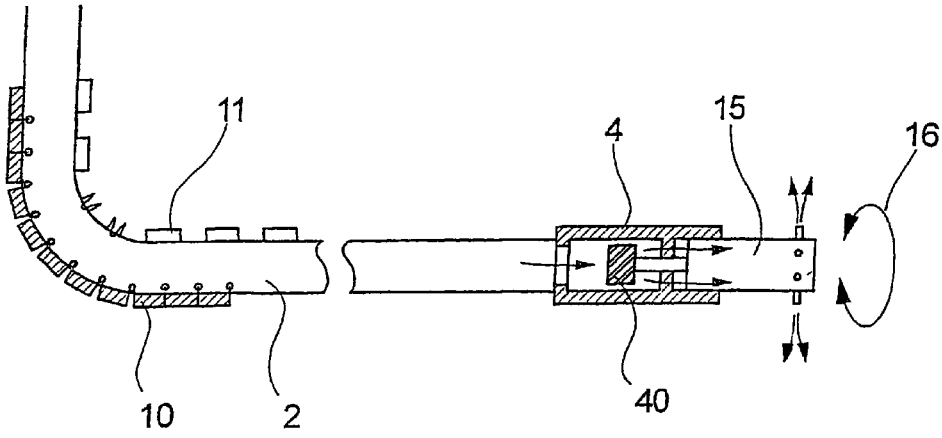
FIG. 4 is a fragmentary, side-elevational view of a third variant of a bendable embodiment of a supply line with a nozzle head.

FIG. 4 also shows a further embodiment of the supply line 2. In this case, the supply line 2 on one hand has curvature limiters 11 as well as holding elements 10 at the bottom on its surface. Reference should be made to the general description for the configuration of such holding elements 10 and curvature limiters 11. Once again, a fluid distribution device 4 is provided at the end 5 of the supply line 2. This fluid distribution device 4 is constructed in such a way that it can rotate at least partially with respect to the supply line 2, so that cleaning fluid 3 can thus be distributed at the same time over the entire circumference as indicated by reference numeral 16. The fluid distribution device 4 is rotated by the provision of an impeller wheel 40 in the fluid flow, which results in the nozzle head 15 carrying out a rotary movement as a result of the cleaning fluid flowing through it. The nozzle head 15 has a plurality of nozzles which are distributed over the circumference 16, and through which the cleaning fluid 3 finally emerges.

Figure 5:
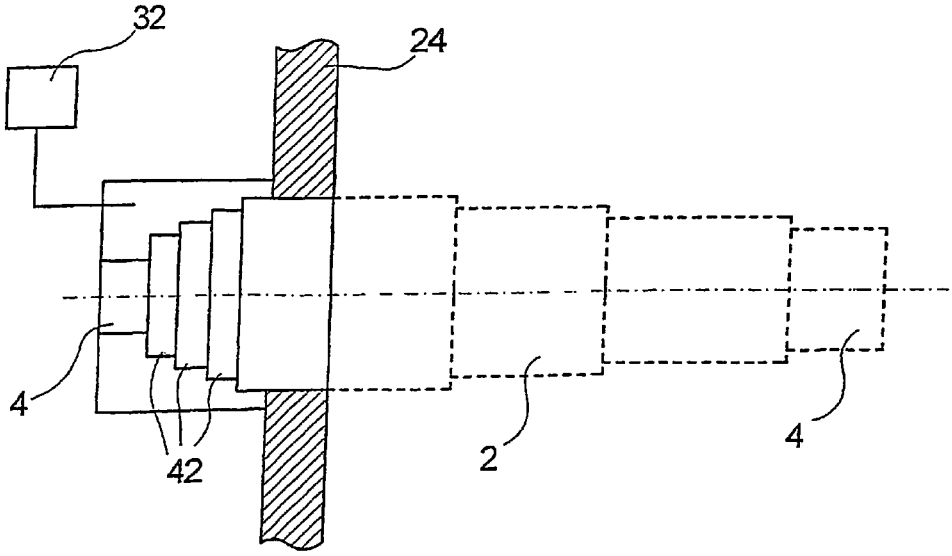
FIG. 5 is a fragmentary, partially-sectional, side-elevational view of a telescopic embodiment of the supply line.

FIG. 5 shows another embodiment of the supply line 2, in which case the supply line 2 is telescopic. The telescopic embodiment of the supply line 2 on the heating installation 24 is illustrated in the state when no cleaning process is taking place. The fluid distribution device 4 is then located outside the heating installation 24. The supply line 2 is provided with a drive 32 which makes it possible to move various segments 42 of the supply line 2 with respect to one another, so that they can extend into the internal areas of the heating installation 24, as is illustrated by dashed lines. A space-saving soot blower is also provided in this way.

Figure 6:
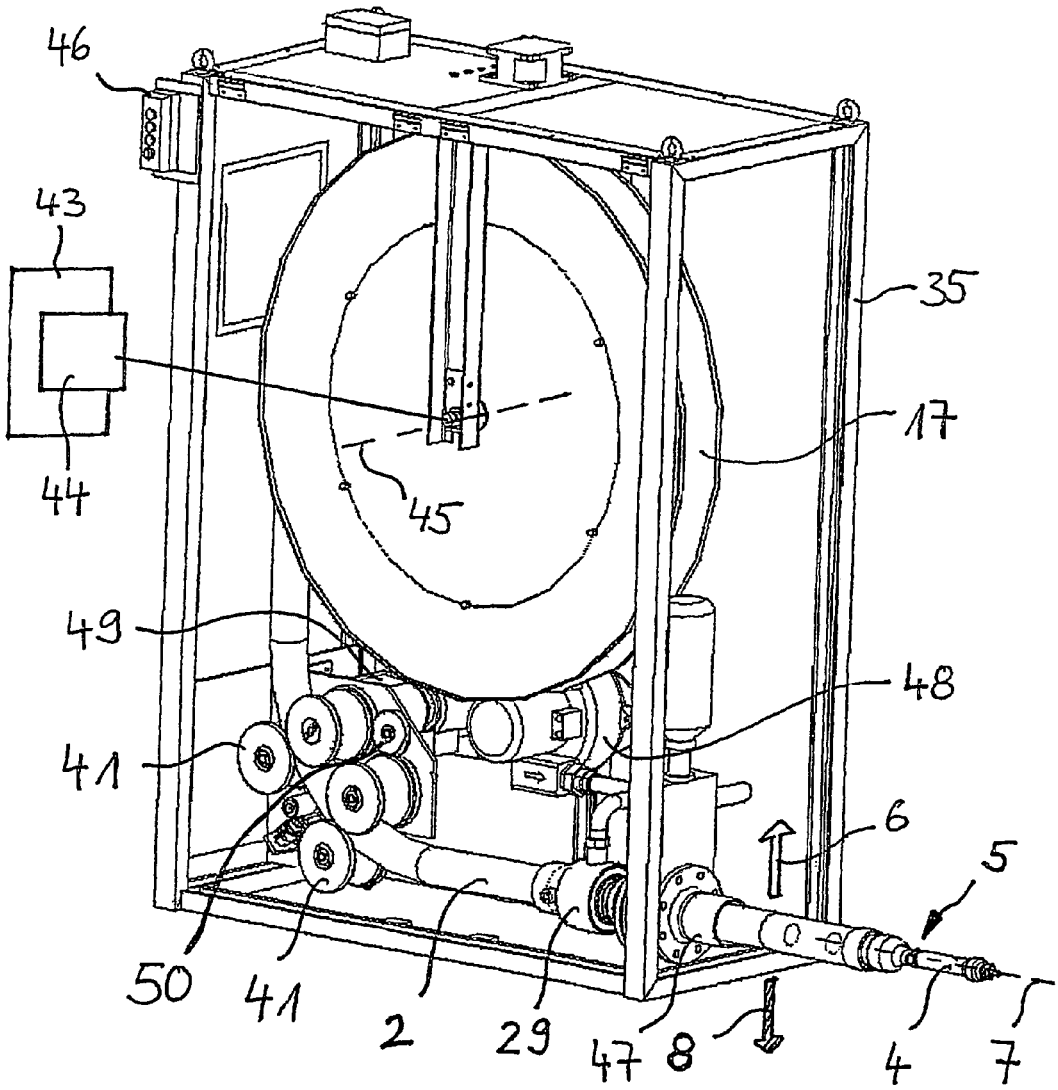
FIG. 6 is a perspective view of yet another embodiment of a cleaning apparatus according to the invention.

The perspective illustration in FIG. 6 discloses yet another embodiment of a cleaning apparatus according to the invention. In contrast to the variant in FIG. 1, the storage apparatus 17 in this case is also constructed to be mobile, that is to say it can be moved together with the housing 35 to the desired supply opening 26 of the heating installation 24. This has the advantage, inter alia, of permitting the required length of the supply line to be considerably reduced. Since the storage apparatus is moved directly in front of the supply opening 26, only a supply line 2 with a length 18 corresponding to the desired penetration depth into the heating installation 24 substantially need be provided.

The illustrated apparatus for the cleaning of heat exchanging surfaces 1 has a supply line 2 for cleaning fluids and a fluid distribution device 4 which is disposed at one end 5 of the at least one supply line 2. In this case, the supply line 2 is constructed in such a way that it can bend in a first direction 6 transversely with respect to the extent axis 7, and in such a way that it is resistant to bending in a second direction 8.

In addition to the storage apparatus 17, the housing 35 also includes a plurality of other components of the cleaning apparatus. A cooling/barrier supply 29 can thus be seen in the area of the outlet 47 of the supply line 2 from the housing 35, through the use of which a type of surrounding jet of air is produced around the supply line 2 to the outlet 47. A fan 48 that is required for this purpose is likewise integrated in the housing 35. The drive system for the supply line 2, with two driven roller pairs 41, is also illustrated between the storage apparatus 17 and the cooling/barrier supply 29. The roller pairs 41 have profiles corresponding to the external shape of the supply line 2 and are driven synchronously by a motor 49 and gearwheels 50 at predeterminable speeds and with predeterminable pressure forces. In this case, the roller pairs 41 are disposed in such a way that they deflect the supply line 2 in another direction at the same time, in this case horizontally.

With regard to the configuration of the storage apparatus 17, it should be noted that the storage apparatus 17 is in the form of a narrow spool that is constructed for winding up, in only one layer, the supply line 2 which is in the form of a flexible tube. The spool is accordingly relatively narrow in the direction of a rotation axis 45, and in particular is only slightly broader than the diameter of the supply line 2, thus providing good guidance during winding up and unwinding. The spool also has a schematically illustrated drive 43 associated therewith which rotates the spool. In this case, a sliding clutch is connected in between as a tensioner 44, in which case both the drive 43 and the tensioner 44 are preferably disposed within the housing 35.

The housing 35, with the components contained therein, can now be positioned in front of a supply opening 26 and can be activated manually through the use of a control element 46 and/or for example on the basis of an identified degree of contamination of the heat exchanging surfaces 1 to be cleaned. The cleaning apparatus can accordingly be operated semi-automatically or even fully-automatically. A plurality of mobile cleaning appliances according to the invention are preferably provided for a heating installation, in which case they can each preferably move in a horizontal working area. A configuration such as this avoids the need for interrupting horizontal working platforms, which run along the heating installation, for the movement of a cleaning appliance, and in fact one mobile cleaning apparatus is preferably in each case provided between such working platforms.

Figure 7:
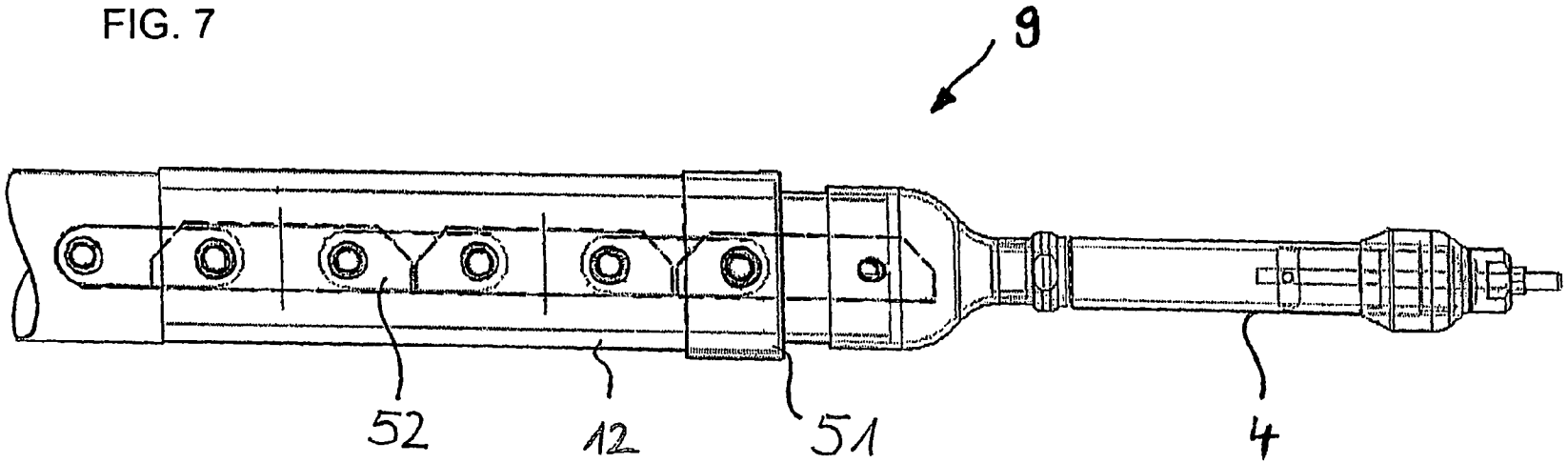
FIG. 7 is a fragmentary, side-elevational view of a refinement of the supply line with a fluid distribution device.

FIG. 7 diagrammatically illustrates an embodiment of the supply line in the form of a flexible tube 9 with a fluid distribution device 4. The flexible tube 9 in this case is formed with a single casing 12, through which the cleaning fluid is also passed during the cleaning process. A chain belt 52 is disposed within this casing 12 and is responsible for the bending stiffness of the flexible tube 9. Links of the chain belt 52 can pivot only upwards from the illustrated position. The chain belt 52 is preferably composed of a heat-resistant material which cannot rust, for example steel or plastic. The configuration of the chain belt 52 having direct contact with the cleaning fluid 3 has the advantage of resulting in effective cooling even when the cleaning process is carried out during operation of the heating installation 24.

Electrical cables, etc., for example, can also be passed through the flexible tube 9 in addition to at least one chain belt 52. These electrical cables may be used to provide a connection for sensors, adjustment apparatuses for the nozzle or the like.

The chain belt 52 is connected to the flexible tube 9 through an end piece 51. This connection is preferably constructed to be detachable, in the same way that a connection of the fluid distribution device 4 to the end piece 51 is preferably constructed to be detachable. The end piece 51 preferably also has the function of centering the chain belt 52 with respect to the flexible tube 51. The chain belt 52 in this case is constructed to be relatively thin in order to prevent the flexible tube 9 from being heavy and to provide as little flow resistance as possible for the cleaning fluid 3.

At this point, it should once again be noted that the figures show embodiment variants of cleaning apparatuses to which the invention is not restricted. In particular, the various embodiment variants also show details which can be used in other exemplary embodiments or in a different context with the same advantage.

I claim:

1. A heating installation and heating installation cleaning assembly, comprising:

a heating installation having heat exchanging surfaces; and an apparatus for cleaning said heat exchanging surfaces, said apparatus having:

at least one supply line for a cleaning fluid, said at least one supply line to be inserted into said heating installation transversely to the direction of the force of gravity and having a substantially straight unbent profile within said heating installation, said at least one supply line having a supporting section extending for at least 1.5 m, said substantially straight profile being self-supporting at least over said supporting section, said at least one supply line having a variable shape and an end, and said at least one supply line having an extent axis, being bendable in a first direction transverse to said extent axis, and being resistant to bending in at least one second direction transverse to said extent axis, said at least one second direction corresponding substantially to the direction of the force of gravity;

at least one fluid distribution device disposed at said end of said at least one supply line;

a device disposed solely outside of said heating installation and not inside of said heating installation for bending said at least one supply line only once outside of said heating installation from a direction parallel to the direction of the force of gravity to a direction for insertion into said heating installation transversely to the direction of the force of gravity and for unbending said at least one supply line from a direction for withdrawal from said heating installation transversely to the direction of the force of gravity to the direction parallel to the direction of the force of gravity; and a device for determining a length of said at least one supply line relative to a predeterminable reference point.

2. The apparatus according to claim 1, wherein said at least one supply line has at least one heat-resistant flexible tube.

3. The apparatus according to claim 2, which further comprises a device for restricting flexibility of said at least one flexible tube in said at least one second direction.

4. The apparatus according to claim 3, wherein said device for restricting flexibility of said at least one flexible tube includes at least one of:

a holding element pivotable in one dimension; or a curvature limiter.

5. The apparatus according to claim 2, wherein said at least one flexible tube has at least first and second casings, said second casing has an interior for a flow of the cleaning fluid, and supporting elements are disposed between said first casing and said second casing for making said at least one supply line resistant to bending in at least said at least one second direction.

6. The apparatus according to claim 1, wherein said at least one fluid distribution device is a nozzle head.

7. The apparatus according to claim 1, wherein said at least one fluid distribution device is rotatable relative to said at least one supply line and can distribute cleaning fluid at the same time over an entire circumference of said at least one fluid distribution device.

8. The apparatus according to claim 1, wherein said at least one fluid distribution device is rotatable relative to said at least one supply line.

9. The apparatus according to claim 1, wherein said at least one fluid distribution device can distribute cleaning fluid at the same time over an entire circumference of said at least one fluid distribution device.

10. The apparatus according to claim 1, which further comprises at least one storage apparatus for said at least one supply line, said at least one supply line being disposed in or on said at least one storage apparatus so as to be at least partially bent in said first direction.

11. The apparatus according to claim 10, wherein said at least one storage apparatus is an apparatus for rolling up said at least one supply line.

12. The apparatus according to claim 1, which further comprises a device for carrying out a relative movement of said at least one fluid distribution device and a reference point of the apparatus.

13. The apparatus according to claim 1, which further comprises a device for supplying said at least one supply line with the cleaning fluid.

14. The apparatus according to claim 13, wherein said cleaning fluid supply device is at least one device selected from the group consisting of a pump, a fluid flow measurement unit, a vaporizer and a valve.

15. The assembly according to claim 1, wherein:

said heating installation has a supply opening and inner areas;

said at least one supply line can be passed from outside through said supply opening into said inner areas; and a device produces a bend in said at least one supply line outside said heating installation.

16. The assembly according to claim 1, wherein said at least one supply line extends substantially in the direction of the force of gravity.

17. The assembly according to claim 1, which further comprises at least one storage apparatus outside said heating installation, said at least one supply line being disposed in or on said at least one storage apparatus.

18. The assembly according to claim 1, wherein said heating installation has a supply opening, and a device seals said at least one supply opening and cools said at least one supply line.

19. The assembly according to claim 1, wherein said heating installation has a supply opening, and a device seals said at least one supply opening.

20. The assembly according to claim 1, which further comprises a device for automatically controlling said apparatus for cleaning said heat exchanging surfaces.

21. The assembly according to claim 1, which further comprises a device for cooling said at least one supply line.

22. A method for carrying out a relative movement between at least one supply line and a heating installation, the method comprising the following steps:

identifying an initiation parameter;

inserting the at least one supply line having a variable shape and an end with a fluid distribution device through an appropriate supply opening into the heating installation transversely to the direction of the force of gravity;

providing the at least one supply line within the heating installation with a substantially straight unbent profile being self-supporting at least over a supporting section extending for at least 1.5 m;

bending the at least one supply line only once outside of said heating installation from a direction parallel to the direction of the force of gravity to a direction for insertion into the heating installation transversely to the direction of the force of gravity, with a bending device disposed solely outside of and not inside of the heating installation, in a first direction transverse to an extent axis and resisting bending in at least one second direction transverse to the extent axis and corresponding substantially to the direction of the force of gravity;

activating a cleaning fluid flow through the at least one supply line in direction of the heating installation;

identifying a final parameter;

withdrawing the at least one supply line out of the heating installation through the supply opening and unbending said at least one supply line from a direction for withdrawal from the heating installation transversely to the direction of the force of gravity to the direction parallel to the direction of the force of gravity;

at least partially repeatedly deforming the at least one supply line during the inserting and withdrawing steps; and determining a length of the at least one supply line relative to a predeterminable reference point.

23. The method according to claim 22, which further comprises varying at least one of a length or a radius of curvature of the at least one supply line during the inserting and withdrawing steps.

24. The method according to claim 22, which further comprises carrying out the steps of inserting and withdrawing the at least one supply line during operation of the heating installation.

25. The method according to claim 22, wherein at least the initiation parameter or the final parameter includes at least one parameter selected from the group consisting of time, temperature, heat flow and amount of slag.

26. The assembly according to claim 1, wherein said apparatus for cleaning said heat exchanging surfaces is disposed laterally next to a wall of said heating installation and guides said at least one supply line along said wall of said heating installation.

27. The method according to claim 22, which further comprises placing the apparatus for cleaning the heat exchanging surfaces laterally next to a wall of the heating installation and guiding the at least one supply line along the wall of the heating installation.

* * * * *